US009379493B2

(12) United States Patent
Aizawa

(10) Patent No.: US 9,379,493 B2
(45) Date of Patent: Jun. 28, 2016

(54) FERRITE CORE BUILT-IN CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Takeshi Aizawa, Yokkaichi (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES (JP)

( * ) Notice: Subject to any disclaimer, the term of this patent is extended or adjusted under 35 U.S.C. 154(b) by 0 days.

(21) Appl. No.: 14/283,701

(22) Filed: May 21, 2014

(65) Prior Publication Data

US 2014/0349520 A1 Nov. 27, 2014

(30) Foreign Application Priority Data

May 22, 2013 (JP) ..... 2013-108331

(51) Int. Cl.
*H01R 13/6588* (2011.01)
*H01R 13/7193* (2011.01)
(Continued)

(52) U.S. Cl.
CPC ..... *H01R 13/6588* (2013.01); *H01R 13/7193* (2013.01); *H01R 31/08* (2013.01); *H01F 1/344* (2013.01); *H01F 3/08* (2013.01); *H01F 5/003* (2013.01); *H01F 17/04* (2013.01); *H01F 17/045* (2013.01); *H01F 27/255* (2013.01);
(Continued)

(58) Field of Classification Search
CPC ..... H01R 13/6588; H01R 13/7193; H01R 2201/26; H01R 31/08; H01F 2017/048; H01F 17/045; H01F 1/344; H01F 27/292; H01F 41/005; H01F 41/10; H01F 17/04; H01F 27/255; H01F 27/324; H01F 3/08; H01F 41/04; H01F 5/003
USPC ..... 439/620.12, 620.13, 620.05, 607.12
See application file for complete search history.

(56) References Cited

U.S. PATENT DOCUMENTS 6,364,711 B1 * 4/2002 Berg ..... H01R 13/719 439/620.07
2010/0283000 A1 * 11/2010 Shimizu ..... B29B 7/42 252/74
2011/0050535 A1 * 3/2011 Yamaguchi ..... H01Q 1/2283 343/870
(Continued)

FOREIGN PATENT DOCUMENTS

JP 2010-118212 5/2010

*Primary Examiner* — Abdullah Riyami
*Assistant Examiner* — Justin Kratt
(74) *Attorney, Agent, or Firm* — Gerald E. Hespos; Michael J. Porco; Matthew T. Hespos

(57) ABSTRACT

A connector includes ferrite cores (30A, 30B) with through holes (30H). A terminal fitting (20) has tab terminals (22A, 22B) inserted into the respective through holes (30H) to define input and output portions and a base (23) couples end parts of the respective tab terminals (22A, 22B) to each other. A connector housing (11) is molded to surround the ferrite cores (30A, 30B) and the terminal fitting (20) and is connectable to a mating connector housing. The ferrite cores (30A, 30B) include long sides LL and short sides SL. Clearances S are defined between side surfaces M located on the opposite short sides SL of the ferrite cores (30A, 30B) and facing surfaces of the connector housing (11), thereby separating the side surfaces M from the facing surfaces.

7 Claims, 5 Drawing Sheets

(51) Int. Cl.

| | |
|---|---|
| ***H01R 31/08*** | (2006.01) |
| *H01F 5/00* | (2006.01) |
| *H01F 17/04* | (2006.01) |
| *H01F 27/29* | (2006.01) |
| *H01F 41/04* | (2006.01) |
| *H01F 1/34* | (2006.01) |
| *H01F 41/10* | (2006.01) |
| *H01F 3/08* | (2006.01) |
| *H01F 41/00* | (2006.01) |
| *H01F 27/32* | (2006.01) |
| *H01F 27/255* | (2006.01) |

(52) U.S. Cl.
CPC ..... *H01F27/292* (2013.01); *H01F 27/324* (2013.01); *H01F 41/005* (2013.01); *H01F 41/04* (2013.01); *H01F 41/10* (2013.01); *H01F 2017/048* (2013.01); *H01R 2201/26* (2013.01)

(56) References Cited

U.S. PATENT DOCUMENTS

2013/0303023 A1* 11/2013 Miwa ..... H01R 13/506
439/620.05

* cited by examiner

FERRITE CORE BUILT-IN CONNECTOR

BACKGROUND

1. Field of the Invention

The invention relates to a ferrite core built-in connector.

2. Description of the Related Art

Some known connectors control an electronic component installed in an automotive vehicle by CAN (Control Area Network) communication and have a block-shaped ferrite core fit to a busbar terminal projecting in a connecting direction to remove noise current that adversely affects signal transmission.

A connector could be formed by insert molding a ferrite core and a busbar terminal in a connector housing made of synthetic resin. However, the ferrite core may be damaged by a compressive stress due to a contractile force during resin curing. JP 2010-118212 discloses a technique for preventing damage of a ferrite core due to a compressive stress by forming an opening in a connector housing and exposing opposite longitudinal end surfaces of the ferrite core, to which the compressive stress is greatest.

However, an opening formed in the connector housing as described above, reduces the strength of the connector housing.

The invention was completed based on the above situation and aims to provide a ferrite core built-in connector having a strong connector housing.

SUMMARY OF THE INVENTION

The invention relates to a ferrite core built-in connector that has at least one ferrite core with a plurality of through holes. The connector also has a terminal fitting with a tab terminals and a base. The tab terminals are to be inserted into the respective through holes of the ferrite core and define input and output portions. The base couples end parts of the respective tab terminals to each other. A connector housing is molded to surround the ferrite core and the terminal fitting and is connectable to a mating connector housing. The ferrite core includes long sides and short sides. Clearances are defined between side surfaces located on the opposite short sides of the ferrite core and facing surfaces of the connector housing, thereby separating the side surfaces from the facing surfaces The ferrite core preferably is fit to each tab terminal from a tip side, and a retaining wall is molded integrally or unitarily to the connector housing to lie at a position on or near a front surface of the ferrite core. The retaining wall reliably prevents detachment of the ferrite core from the terminal fitting.

Parts of the ferrite core through which the respective input tab terminals and the output tab terminals penetrate may have different respective frequency ranges where noise components are removable. Accordingly, the ferrite core having different frequency ranges where noise components are removable are provided in a conductive path from the input portion to the output portion. Thus, a noise removal characteristic in the ferrite core built-in connector is improved.

At least first and second different types of ferrite cores may be provided. The first ferrite core may have a high removal effect of removing noise components in an FM frequency range and the second ferrite core may have a high removal effect of removing noise components in an AM frequency range.

The first ferrite core may be a Ni—Zn based ferrite, and/or the second ferrite core may be a Mn—Zn ferrite.

Substantially an entire surface of the ferrite core may be coated with a resin.

A molding die that is used to mold the connector may comprise a first die and a second die that can be opened and closed. The die defines a molding space in which the connector housing can be molded around the ferrite core and the terminal fitting when the ferrite core and the terminal fitting are placed in the die.

The first die may be formed with a recessed first molding portion for forming an outer shape of the connector housing and the second die may be formed with a projecting second molding portion that is inserted into the first molding portion and can mold a receptacle of the connector housing between the first and second molding portions when the die is closed. One or more molding projections may project from one or more ends of the second molding portion on sides substantially corresponding to the short sides of the ferrite core. The molding projections cover side surfaces of the short sides of the ferrite core while being held in close contact therewith when the die is closed so as to cause clearances to be defined between the side surface(s) of the short sides of the ferrite core and inner surfaces of the connector housing after the connector housing is molded. Accordingly the side surfaces located on the short sides of the ferrite core and the facing surfaces of the connector housing are separated by the clearances defined therebetween. Thus, a contractile force will not act one the ferrite core after the connector housing is molded. As a result, it is not necessary to provide an opening in the connector housing, as in conventional ferrite core built-in connectors, and there is no possibility of reducing the strength of the connector housing.

These and other features of the invention will become more apparent upon reading the following detailed description of preferred embodiments and accompanying drawings.

DETAILED DESCRIPTION OF THE PREFERRED EMBODIMENTS

A ferrite core built-in connector 10 (hereinafter, merely referred to as a connector 10) of this embodiment includes a busbar terminal 20, first and second types of ferrite cores 30A, 30B for noise removal, and a connector housing 11. Note that, in the following description, right and left sides of FIG. 3 are referred to as front and rear sides concerning a front-back direction.

Figure 3:
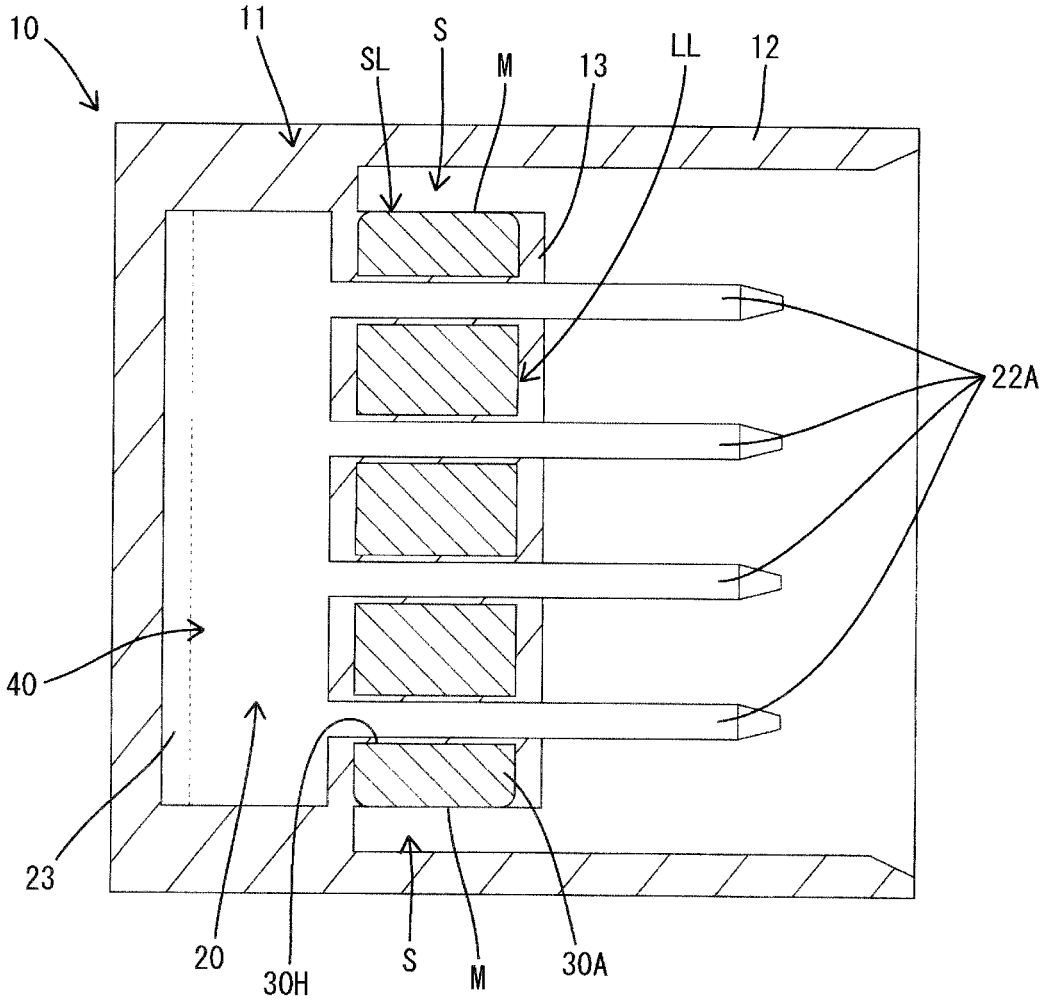
FIG. 3 is a plan view in section of the ferrite core built-in connector of FIG. 1.

The connector housing 11 is made e.g. of synthetic resin and includes, as shown in FIG. 3, a rectangular tubular receptacle 12 having a front opening 11H and a circuit unit 40 incorporated integrally in the receptacle 12 by insert molding. The circuit unit 40 comprises the busbar terminal 20 and the ferrite cores 30A, 30B.

Figure 1:
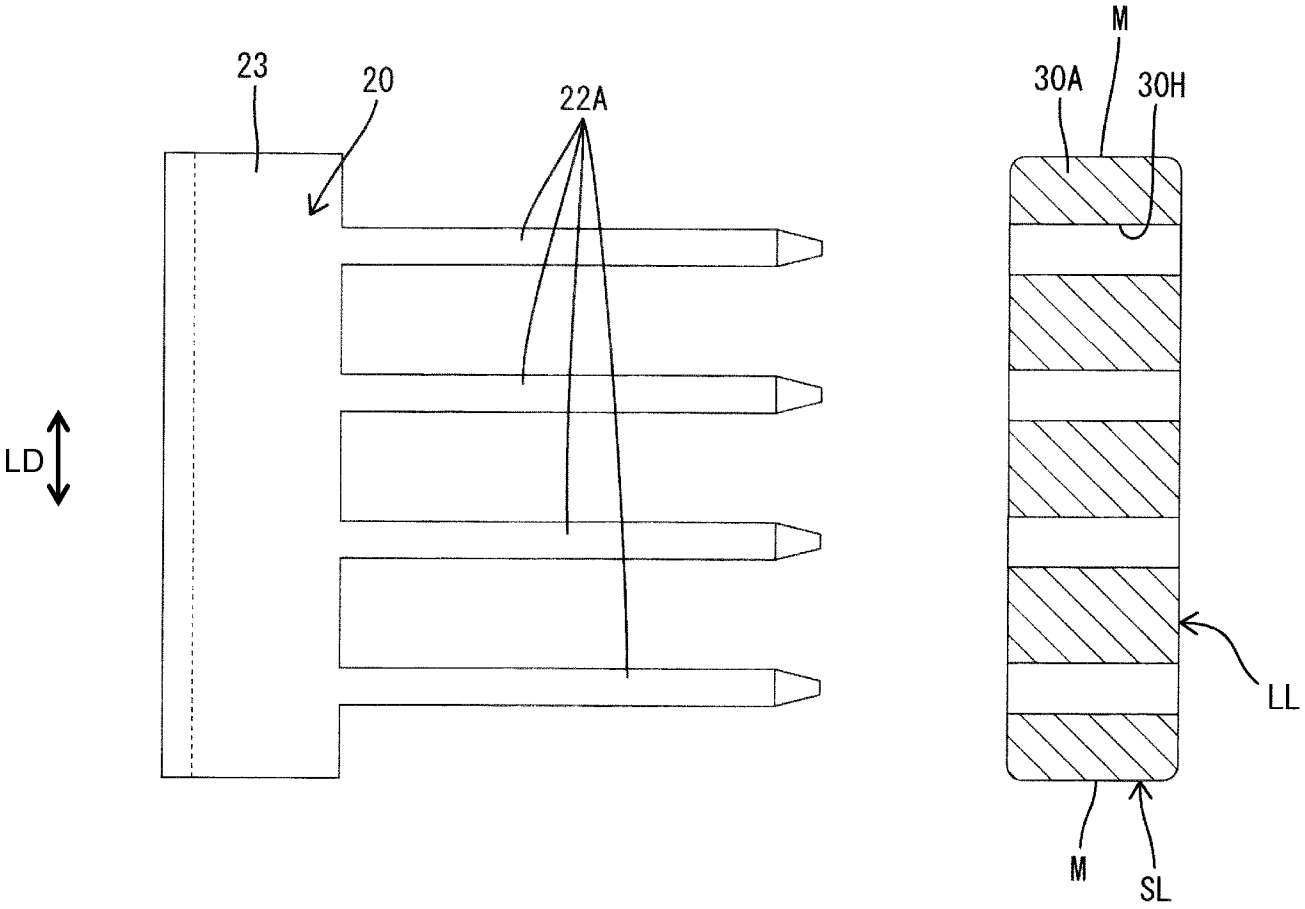
FIG. 1 is a diagram of a busbar terminal and a ferrite core according to one embodiment of the invention.
Figure 2:
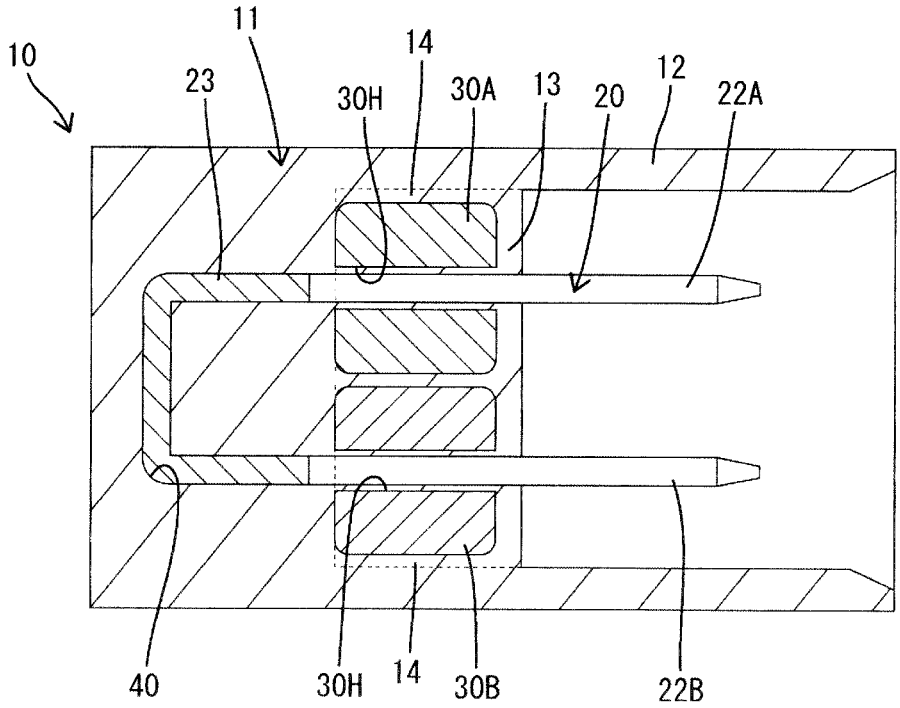
FIG. 2 is a side view in section of a ferrite core built-in connector of FIG. 1.

The busbar terminal 20 is formed by cutting or punching a metal conductive plate material, such as copper alloy, and applying bending, folding and/or embossing and the like to a cut- or punched-out piece. The busbar terminal 20 has tab-shaped tab terminals 22A, 22B and a base 23 that couples ends of the tab terminals 22A, 22B, as shown in FIG. 2. Four tab terminals 22A are in an upper level and define positive electrode side terminals (input portion) 22A. Four tab terminals 22B are in a lower level and define negative electrode side terminals (output portion) 22B. The tab terminals 22A, 22B are at substantially equal intervals and extend in a longitudinal direction LD from the base 23, as shown in FIG. 1. The eight tab terminals 22A, 22B are to be connected electrically to respective female terminal fittings of an unillustrated mating connector.

The first ferrite core 30A has a high removal effect of removing noise components in an FM frequency range and the second ferrite core 30B has a high removal effect of removing noise components in an AM frequency range. Ni—Zn based ferrite is used as the material of the ferrite core 30A, and Mn—Zn ferrite material is used as the material of the second ferrite core 30B. The first and second ferrite cores 30A, 30B are substantially block-shaped and include short sides SL and long sides LL. Four through holes 30H are open on each of the first and second ferrite cores 30A, 30B so that the tab terminals 22A, 22B can be passed therethrough in a press-fit manner. Further, the entire surface of each of the first and second ferrite cores 30A, 30B is coated with an unillustrated thin resin coating to prevent damage of the ferrite cores 30A, 30B when the ferrite cores 30A, 30B are mounted on the tab terminals 22A, 22B.

Figure 5:
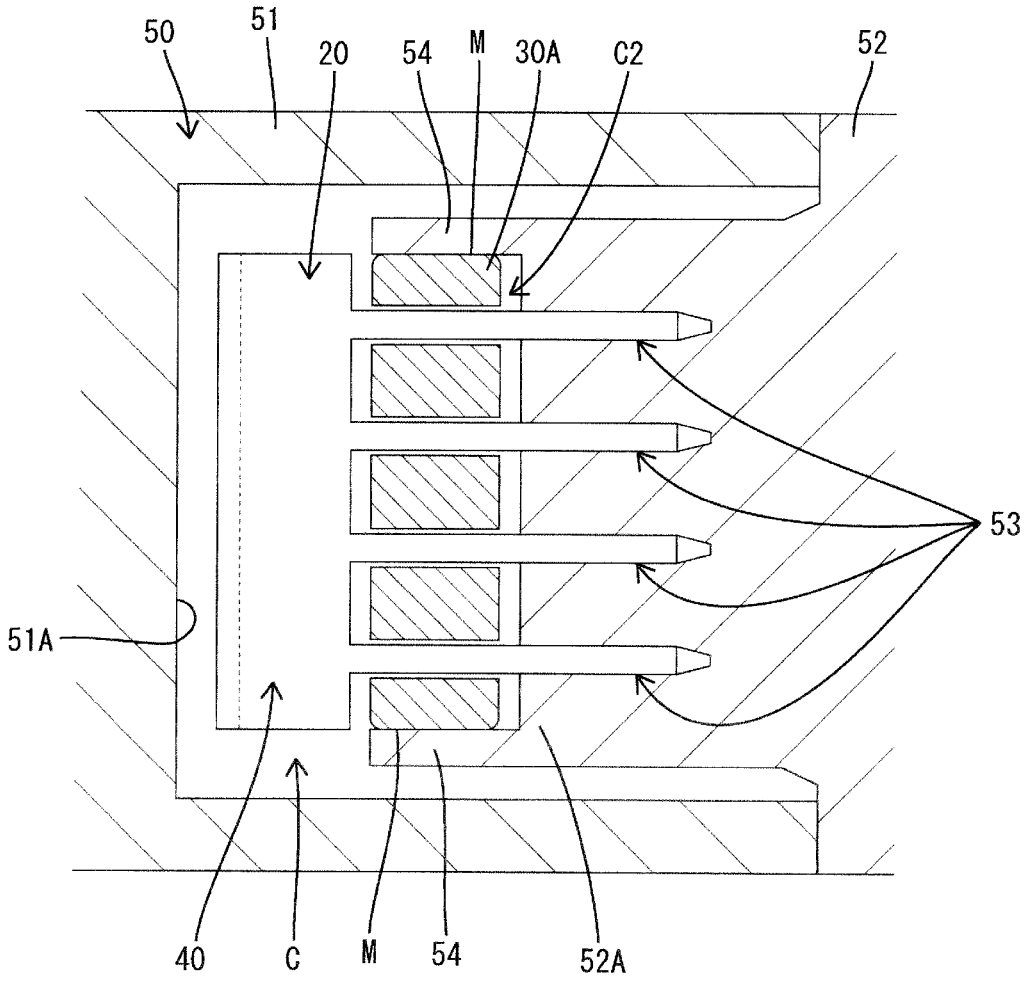
FIG. 5 is a diagram when the ferrite core built-in connector of FIGS. 1-3 is insert-molded.

A molding die 50 in this embodiment comprises a first die 51 and a second die 52 that can be opened and closed as shown in FIG. 5. The die 50 has a molding space C in which the connector housing 11 can be molded around the circuit unit 40 when closed with the circuit unit 40 placed in the die 50.

As shown in FIG. 5, the first die 51 is formed with a recessed first molding portion 51A for forming the outer shape of the connector housing 11. The second die 52 is formed with a projecting second molding portion 52A that is inserted into the first molding portion 51A and can mold the receptacle 12 between the first and second molding portions 51A, 52A when the die is closed. Escaping holes 53 for avoiding interference with the tab terminals 22A, 22B of the busbar terminal 20 in a die closed state are perforated at a plurality of positions in the second molding portion 52A. The front surface of the second molding portion 52A is set to define a specified clearance C2 between the front surfaces of the ferrite cores 30A, 30B and the front surfaces of the second molding portion 52A in the die closed state, and this clearance C2 is for forming a retaining wall 13 for the ferrite cores 30A, 30B.

Figure 4:
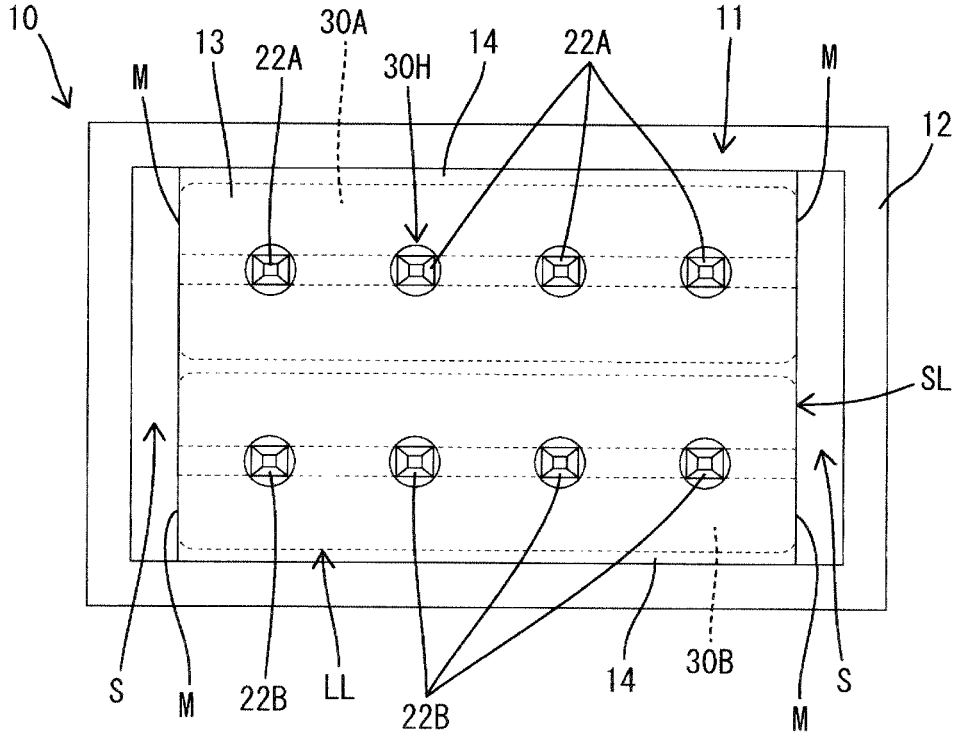
FIG. 4 is a front view of the ferrite core built-in connector of FIGS. 1-3.

Molding projections 54 project from opposite ends of the second molding portion 52A on sides corresponding to the short sides SL of the ferrite cores 30A, 30B. The molding projections 54 cover opposite side surfaces M of the short sides SL of the ferrite cores 30A, 30B while being held in substantially close contact therewith when the die is closed. Thus clearances S will be defined between the opposite side surfaces M of the short sides SL of the ferrite cores 30A, 30B and inner facing surfaces of the receptacle 12, as shown in FIG. 3, after the connector housing 11 is molded. However, molding projections 54 are not provided in the second molding portion 52A at positions corresponding to the long sides LL of the ferrite cores 30A, 30B. Thus, after the connector housing 11 is molded, the opposite side surfaces on the long sides LL of the ferrite cores 30A, 30B are covered by protection wall 14 molded unitarily in a state connected to inner surfaces of the receptacle 12 and the retaining wall 13, as shown in FIGS. 2 and 4.

The connector 10 is produced by first inserting the tab terminals 22A of the busbar terminal 20 as the positive electrode side terminals 22A through the respective through holes 30H of the first ferrite core 30A until the first ferrite core 30A contacts the base 23. Similarly, the tab terminals 22B of the busbar terminal 20 as the negative electrode side terminals 22A also are fit into through holes 30H of the second ferrite core 30B until the second ferrite core 30B contacts the base 23, thereby assembling the circuit unit 40.

Subsequently, the die is closed with the circuit unit 40 placed between the first and second dies 51, 52 to form the molding space C for the connector housing 11. Molten resin then is poured through a gate (not shown) in the first die 51. The pouring of the resin is stopped when the resin is filled in the entire molding space C. When the curing of the resin is completed, the connector housing 11 is formed by insert molding and the assembling of the connector housing 10 is completed.

As shown in FIG. 5, the molding projections 54 provided on the second die 52 cover the opposite side surfaces M of the short side portions SL of the ferrite cores 30A, 30B while being held substantially in close contact therewith. Thus, the resin does not flow into between the opposite side surfaces M of the short side portions SL of the ferrite cores 30A, 30B and the inner surfaces of the receptacle 12, and hence the clearances S are formed. On the other hand, the resin flows into the clearance C2 between a molding surface of the second molding portion 52A and the front surfaces of the ferrite cores 30A, 30B to form the retaining wall 13 on the front surfaces of the ferrite cores 30A, 30B. Further, the opposite side surfaces located on the long side portions LL of the ferrite cores 30A, 30B are covered by the protection walls 14 formed in the state connected unitarily to the inner surfaces of the receptacle 12 and the retaining wall 13.

Signal currents containing noise components and input to the positive electrode side terminals 22A of the connector 10 have noise currents in the FM and/or AM frequency ranges removed by passing by way of the first and second ferrite cores 30A, 30B. Only clear signal currents are output from the negative electrode side terminals 22B.

According to this embodiment, the opposite side surfaces M located on the short sides SL of the ferrite cores 30A, 30B and the inner surfaces of the receptacle 12 of the connector housing 11 are separated by the clearances S defined therebetween. Thus, no contractile force acts on the ferrite cores 30A, 30B after the connector housing 11 is molded. By adopting such a measure, it is not necessary to provide an opening in the connector housing 11 as in conventional ferrite core built-in connectors. Thus, there is no possibility of reducing the strength of the connector housing 11.

The retaining wall 13 is formed unitarily to the connector housing 11 and is arranged on the front surfaces of the ferrite cores 30A, 30B. Thus, the ferrite cores 30A, 30B will not detach from the busbar terminal 20.

Two types of ferrite cores 30A, 30B having different frequency ranges where noise components can be removed are provided in a conductive path from the positive electrode side terminals 22A as the input portion to the negative electrode side terminals 22B as the output portion Thus, a noise removal characteristic in the connector 10 is improved.

As described above, the invention provides the ferrite core built-in connector 10 that does not impair the strength of the connector housing 11 while preventing damage to the ferrite cores 30A, 30B.

The invention is not limited to the above described embodiment. For example, the following embodiments also are included in the scope of the invention.

Although the ferrite cores are block-shaped in the above embodiment, there is no limitation to this and they may be ring-shaped.

Although the two types of ferrite cores, i.e. the first ferrite core made of Ni—Zn based ferrite material and the second ferrite core made of Mn—Zn based ferrite material are used in the above embodiment, there is no limitation to this and either one of the two types may be used.

Although the two types of ferrite cores, i.e. the first and second ferrite cores are used in the above embodiment, there is no limitation to this and one, three or more types of ferrite cores having different frequency ranges where noise components can be removed may be used.

Although the terminal fitting includes eight tab terminal portions in the above embodiment, the number of the tab terminal portions is not limited.

Although the tab terminal portions are provided in two upper and lower levels in the above embodiment, there is no limitation to this and they may be provided in one, three or more levels.

Although the ferrite cores are fitted to the tab terminal portions in the upper and lower levels in the above embodiment, there is no limitation to this and the ferrite core may be fitted only to the tab terminal portions in the upper or lower level.

Although Ni—Zn based ferrite material and Mn—Zn based ferrite material are used for the ferrite cores in the above embodiment, the materials of the ferrite cores are not limited. Further, even if the same materials are used, they may be nanocrystalline materials instead of ceramic materials.

Although the respective pairs of tab terminal portions constituting a pair of the input and output portions are coupled by the base portion in the above embodiment, there is no limitation to this and only the input and output portions may be coupled by the base portion without coupling the respective pairs of tab terminal portions (???). In this case, the tab terminal portions of each pair are electrically separated.

What is claimed is:

1. A connector, comprising:

at least one ferrite core including opposite front and rear surfaces, first and second parallel long sides extending between the front and rear surfaces and first and second short sides extending between the front and rear surfaces and between the first and second long sides, and a plurality of through holes extending through the at least one ferrite core between the front and rear surfaces;

a terminal fitting formed with a plurality of tab terminals inserted through the respective through holes from the rear surface to the front surface to define input and output portions, and a base coupling the respective tab terminals to each other; and a housing molded from resin that surrounds the base of the terminal fitting while leaving tip sides of the tab terminals exposed, and the resin further covering the front and rear surfaces of the ferrite core and the first and second long sides of the ferrite core without contacting the first and second short sides of the ferrite core so that the resin does not impose contractile forces in directions parallel to the long sides during curing of the resin.

2. The connector of claim 1, wherein the ferrite core is fit to each tab terminal from a tip side, and wherein the resin covering the front surface of the ferrite core defines a retaining wall unitary with the resin covering the long sides of the ferrite core.

3. The connector of claim 1, wherein a part of the ferrite core through which the tab terminal portion serving as the input portion penetrates and a part of the ferrite core through which the tab terminal portion serving as the output portion penetrates have different frequency ranges where noise components are removable.

4. The connector of claim 3, wherein at least two ferrite cores of two types are provided, wherein a first ferrite core has a high removal effect of removing noise components in an FM frequency range and a second ferrite core has a high removal effect of removing noise components in an AM frequency range.

5. The connector of claim 4, wherein the first ferrite core is a Ni—Zn based ferrite, and/or wherein the second ferrite core is a Mn—Zn ferrite.

6. The connector of claim 1, wherein a substantially entire surface of the ferrite core is coated with a resin coating.

7. A connector, comprising:

at least one cuboid-shaped ferrite core having four long quadrilateral surfaces and first and second short end surfaces extending between and substantially normal to the four quadrilateral surfaces, and a plurality of through holes extending through the at least one ferrite core parallel to the first and second short end surfaces;

a terminal fitting formed with a plurality of tab terminals inserted into the respective through holes to define input and output portions, and a base coupling the respective tab terminals to each other; and a housing molded from resin so that the resin at least partly surrounds the base of the terminal fitting and covers the four long quadrilateral surfaces of the ferrite core without contacting the first and second short end surfaces of the ferrite core so that the resin does not impose contractile forces in directions parallel to the four long quadrilateral surfaces of the ferrite core during curing of the resin.

* * * * *